US007800542B2

(12) United States Patent
Li et al.

(10) Patent No.: US 7,800,542 B2
(45) Date of Patent: Sep. 21, 2010

(54) MULTI-LAYER OFFSET PATCH ANTENNA

(75) Inventors: Qian Li, Ann Arbor, MI (US); Wladimiro Villarroel, Ypsilanti, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 21 days.

(21) Appl. No.: 12/125,990

(22) Filed: May 23, 2008

(65) Prior Publication Data

US 2009/0289852 A1 Nov. 26, 2009

(51) Int. Cl.
*H01Q 1/32* (2006.01)

(52) U.S. Cl. ..... 343/700 MS

(58) Field of Classification Search ..... 343/700 MS, 343/829, 846

See application file for complete search history.

(56) References Cited

U.S. PATENT DOCUMENTS

| | | | | |
|---|---|---|---|---|
| 4,686,535 | A * | 8/1987 | Lalezari | 343/700 MS |
| 4,827,271 | A | 5/1989 | Berneking et al. | |
| 4,835,538 | A | 5/1989 | McKenna et al. | |
| 5,003,318 | A | 3/1991 | Berneking et al. | |
| 5,245,349 | A | 9/1993 | Harada | |
| 5,519,406 | A * | 5/1996 | Tsukamoto et al. | 343/700 MS |
| 5,874,919 | A | 2/1999 | Rawnick et al. | |
| 5,990,836 | A * | 11/1999 | Bhattacharyya | 343/700 MS |
| 6,118,406 | A | 9/2000 | Josypenko | |
| 6,329,959 | B1 | 12/2001 | Varadan et al. | |
| 6,417,806 | B1 * | 7/2002 | Gothard et al. | 343/700 MS |
| 6,639,558 | B2 | 10/2003 | Kellerman et al. | |
| 6,717,549 | B2 | 4/2004 | Rawnick et al. | |
| 6,788,264 | B2 | 9/2004 | Du | |
| 6,809,686 | B2 | 10/2004 | Du et al. | |
| 6,856,300 | B2 | 2/2005 | McCarrick | |
| 6,977,614 | B2 | 12/2005 | Poe et al. | |
| 6,982,672 | B2 | 1/2006 | Lin et al. | |
| 7,071,878 | B2 | 7/2006 | Masutani | |
| 7,164,385 | B2 | 1/2007 | Duzdar et al. | |
| 7,190,316 | B2 | 3/2007 | Yegin et al. | |
| 7,202,818 | B2 | 4/2007 | Anguera Pros et al. | |
| 7,253,770 | B2 | 8/2007 | Yegin et al. | |
| 7,277,056 | B1 | 10/2007 | Thiam et al. | |
| 7,295,167 | B2 | 11/2007 | Aminzadeh et al. | |
| 7,298,340 | B2 | 11/2007 | Ohba | |
| 7,315,283 | B2 | 1/2008 | Chang | |
| 2002/0171595 | A1 | 11/2002 | Schultze et al. | |
| 2004/0090370 | A1 * | 5/2004 | McCarrick | 343/700 MS |
| 2007/0222683 | A1 | 9/2007 | Duzdar et al. | |

* cited by examiner

*Primary Examiner*—Tho G Phan
(74) *Attorney, Agent, or Firm*—Howard & Howard Attorneys PLLC

(57) ABSTRACT

A patch antenna includes a first patch element and a second patch element. Each patch element defines a center. The second patch element is spaced below the first patch element. A connection point is defined on the second patch element for connection to a transmission line. A first plane is defined through the connection point and the center of the second patch element and generally perpendicular to the second patch element. The first patch element is disposed offset the second patch element such that the center of the first patch element does not intersect with the first plane.

20 Claims, 8 Drawing Sheets

MULTI-LAYER OFFSET PATCH ANTENNA

BACKGROUND OF THE INVENTION

1. Field of the Invention

The subject invention generally relates to a patch antenna. Specifically, the subject invention relates to an antenna having multiple patch elements that operates in multiple frequency bands.

2. Description of the Related Art

Patch antennas for receiving radio frequency (RF) signals are well known in the art. Such antennas are often utilized to receive circularly polarized RF signals. Circularly polarized RF signals are typically used in satellite-based radio communication, such as with global positioning system (GPS) and satellite digital audio radio service (SDARS) providers.

Circularly polarized RF signals are generally classified as having either right-hand circular polarization (RHCP) or left-hand circular polarization (LHCP) based on the direction of rotation of the electric field vector of the RF signal. For example, GPS signals typically utilize RHCP and SDARS signals typically utilize LHCP. It is desirous to be able to simultaneously transmit and/or receive both RHCP and LHCP signals with a single antenna, especially in vehicle applications. Furthermore, it is desirous to integrate antennas with the glass of a vehicle, as this integration improves the aerodynamic performance of the vehicle and helps provide the vehicle with an aesthetically-pleasing, streamlined appearance.

Therefore, there is an opportunity to introduce an antenna that simultaneously radiates RHCP and LHCP RF signals on a plurality of frequency bands. Furthermore, there is an opportunity to introduce such an antenna in or on the glass of a vehicle.

SUMMARY OF THE INVENTION AND ADVANTAGES

A patch antenna is disclosed. The antenna includes a first patch element having a center and a second patch element having a center and spaced below the first patch element. A connection point is defined on the second patch element for a connection to a transmission line. A first plane is defined through the connection point and the center of the second patch element and generally perpendicular to the second patch element. The first patch element is disposed offset the second patch element such that the center of the first patch element does not intersect with the first plane.

The angular arrangement of the second patch element with respect to the first patch element, i.e., the offset between the patch elements, provides the antenna with both right-hand circular polarization and left-hand circular polarization. As such, the single antenna may transmit and/or receive different circularly and/or linearly polarized signals having orthogonal or cross polarization characteristics. Therefore, the antenna of this invention, having just one connection point, can provide multiple signals to one or more receivers, such as a global positioning system (GPS) signal and a satellite digital audio radio service signal (SDARS).

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a patch antenna for operating in multiple frequency bands is shown at 20.

Figure 1:
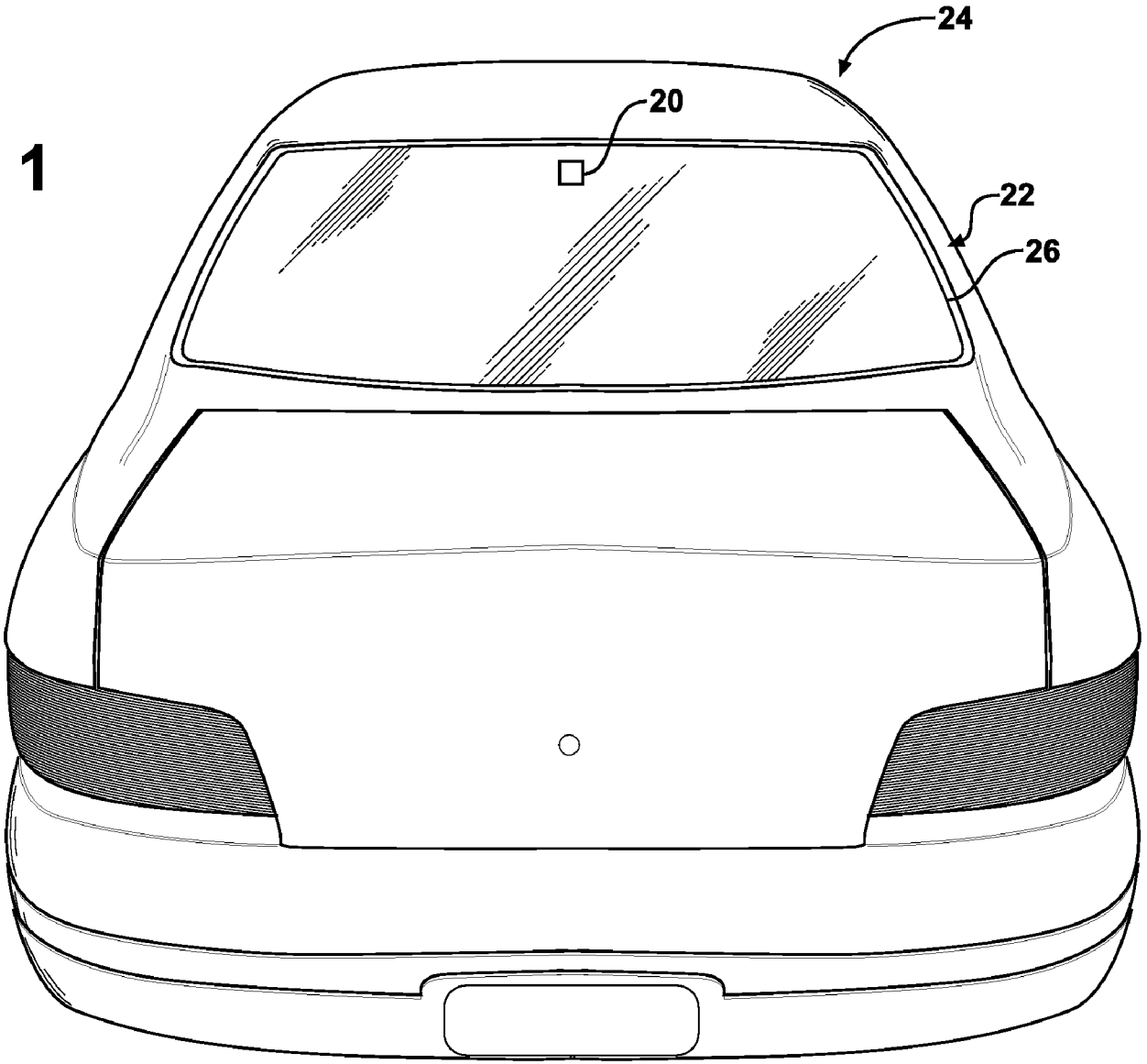
FIG. 1 is a perspective view a vehicle with an antenna supported by a pane of glass of the vehicle.
Figure 2:
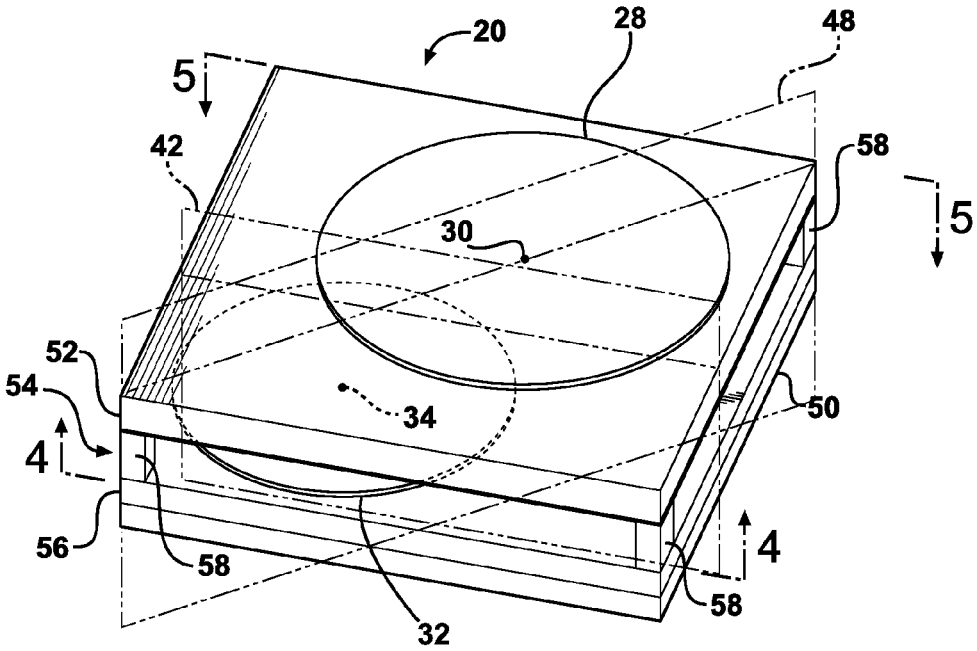
FIG. 2 is a perspective view of a first embodiment of the antenna showing a first patch element and a second patch element.

Referring to FIG. 1, the antenna 20 is preferably integrated with a window 22 of a vehicle 24. The window 22 is preferably formed of at least one non-conductive pane 26 of transparent material, such as glass. However, other materials may also be suitable for forming the transparent, non-conductive pane 26, such as, but not limited to, a resin. Those skilled in the art realize that transparent materials allow light rays to be transmitted through in at least one direction such that objects on the other side of the transparent material may be seen. The window 22 may alternatively be utilized in non-vehicle applications such as buildings (not shown). The antenna 20 may also be implemented in non-window applications, including, but not limited to, electronic devices such as cellular phones. Of course, those skilled in the art realize other applications for the antenna 20. The antenna 20 is described hereafter as integrated with the window 22, but this should not be perceived as limiting in any way.

As stated above, the antenna 20 operates in multiple frequency bands. Particularly, the illustrated embodiments of the antenna 20 defined herein effectively radiates in a first frequency band and a second frequency band. More specifically, the antenna 20 of the illustrated embodiments transmits and/or receives a right-hand circularly polarized (RHCP) signal in the first frequency band and transmits and/or receives a left-hand circularly polarized (LHCP) signal in the second frequency band, or vice-versa. Said another way, the antenna 20 effectively radiates with orthogonal and/or opposite circular polarizations in each of the frequency bands, which is commonly referred to as cross-polarization. However, the antenna 20 may also be utilized to radiate a circularly polarized signal in one frequency band and a linearly polarized signal in another frequency band, as described in greater detail below.

Referring to FIGS. 2-5 and 9-11, the antenna 20 includes a first patch element 28 having a center 30 and a second patch element 32 having a center 34. Each patch element 28, 32 is formed of a conductive material, such as a metal that has properties conducive to conducting electricity. Furthermore, each patch element 28, 32, is substantially flat and forms a periphery (not numbered).

Figure 3:
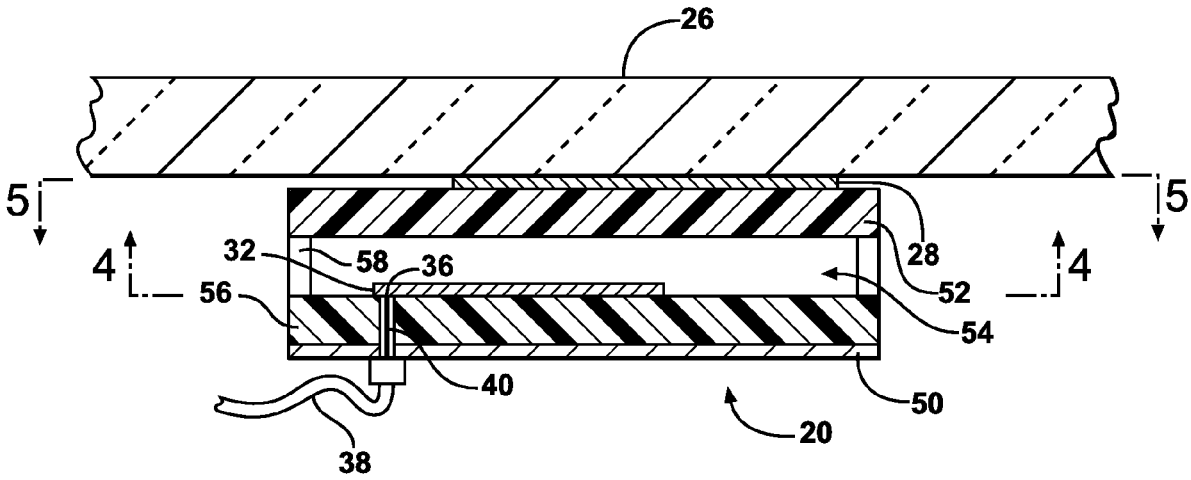
FIG. 3 is a partial cross-sectional view of the first embodiment of the antenna taken along the line 3-3 in FIG. 2 with the first patch element disposed on the pane of glass and a conductor of a transmission line electrically connected to the second patch element.

The first patch element 28 is disposed on the non-conductive pane 26, as shown in FIG. 3. The second patch element 32 is spaced from and non-planar with said first patch element 28. That is, the patch elements 28, 32 do not lie in the same plane or are not co-planar. In the illustrated embodiments, the second patch element 32 is shown disposed below the first patch element 28. However, terminology such as "below" or "above" are based on the perspective of one viewing the elements 28, 32 and should not be read as limiting in anyway. Also, in the illustrated embodiments, the second patch element 32 is disposed farther away from the non-conductive pane 26 than the first patch element 28. Said yet another way, the patch elements 28, 32 are layered with respect to one another.

A connection point 36 is defined on the second patch element 32 for a connection to a transmission line 38. In the illustrated embodiment, as shown in FIG. 3, a conductor 40 of the transmission line 38 is electrically connected to the second patch element 32 at the connection point 36. FIG. 3 shows the conductor 40 in contact with the second patch element 32; however, an electromagnetic coupling between the conductor 40 and the second patch element 32 may alternatively be achieved. Furthermore, FIG. 3 shows a coaxial or unbalanced cable implemented. Those skilled in the art realize that a balanced line cable may alternatively be utilized.

Preferably, the transmission line 38 is also electrically connected to one or more transmitters (not shown) and/or receivers (not shown) as is well known to those skilled in the art. Furthermore, an amplifier, such as a low-noise amplifier (LNA) (not shown) may be utilized to amplify the signal on the transmission line 38.

As stated above, the transmission line 38 is electrically connected to the second patch element 32 while no such direct connection is made to the first patch element 28. Accordingly, the second patch element 32 may be referred to by those skilled in the art as the "active" or "excited" element while the first patch element 28 may be referred to as the "passive" or "parasitic" element.

Figure 9:
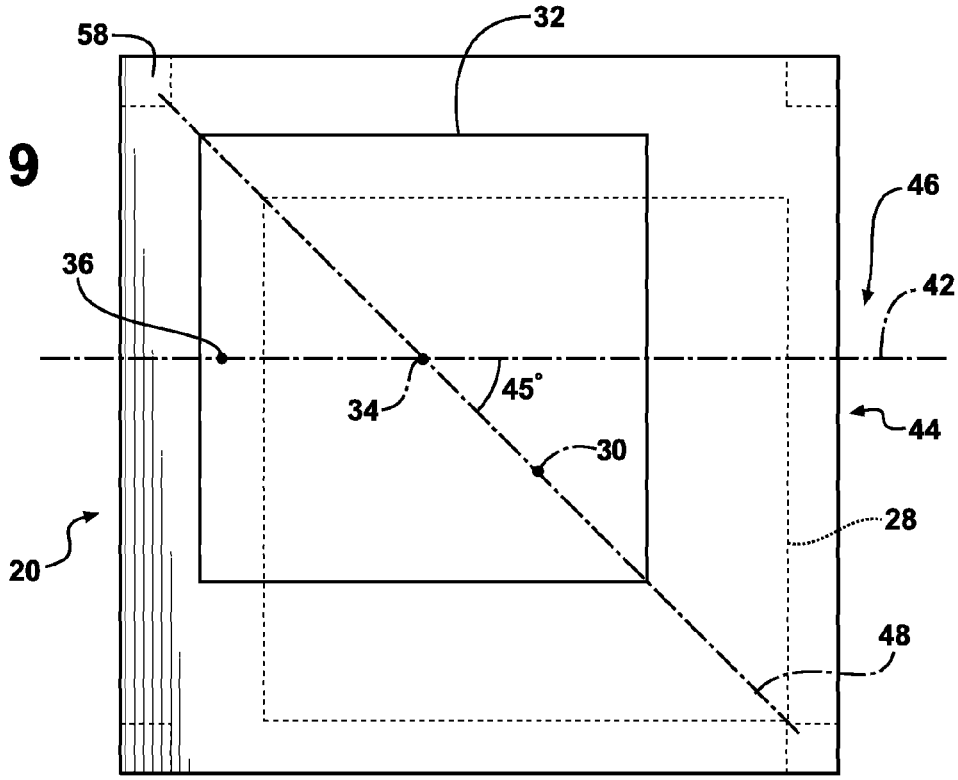
FIG. 9 is an interior view of a second embodiment of the antenna showing the angular relationship between the first and second patch elements having a square shape.

The shape of each patch element 28, 32 is preferably symmetrical about an axis (not shown) through the respective center 30, 34 of each patch element 28, 32. In a first and a third embodiment of the invention, as shown in FIGS. 2-5 and 10, each patch element 28, 32 generally defines a circular shape. However, other shapes for the patch elements 28, 32 may also be utilized. For example, in a second embodiment, as shown in FIG. 9, the patch element defines a square shape. Other polygonal shapes, e.g., triangles, hexagons, and octagons, may also be suitable. In another example, with reference to FIG. 11, a fourth embodiment of the antenna 20, the first patch element 28 has a hexagon shape while the second patch element 32 has a pentagon shape. The patch elements 28, 32 of the fourth embodiment are each symmetrical about an axis through each respective center 30, 34. Those skilled in the art realize additional suitable shapes for the patch elements 28, 32.

In the illustrated embodiments, the periphery of the first patch element 28 has a first length and the periphery of the second patch element 32 has a second length different from the first length. Said another way, the patch elements 28, 32 have different sizes. That is, areas defined within the periphery of each patch element 28, 32 are different from one another. More specifically, in the illustrated embodiments, the second length is less than the first length. The lengths, i.e., the sizes of each patch element 28, 32, are associated with the desired frequency bands of the antenna 20.

In the first embodiment, the antenna 10 radiates in the first frequency band around 2.1 GHz and the second frequency band around 2.8 GHz. To operate in these frequency bands, the first patch element 28 has a radius of about 20.5 mm and the second patch element 32 has a radius of about 17.5 mm. Therefore, the first length of the periphery of the first patch element 28 is about 129 mm and the second length of the periphery of the second patch element 32 is about 110 mm.

To particularly describe the geometrical relationship between the patch elements 28, 32, it is useful to define planes 42, 48 that run through the patch elements 28, 32 and define various regions. Specifically, a first plane 42 is defined through the connection point 36 and the center 34 of the second patch element 32 and generally perpendicular to the second patch element 32. The first plane 42 separates a first region 44 from a second region 46. A second plane 48 is defined through the center 30 of the first patch element 28 and the center 34 of the second patch element 32 and is generally perpendicular to both patch elements 28, 30.

The first patch element 28 is disposed angularly offset from the second patch element 32 such that the center 30 of the first patch element 28 does not intersect with the first plane 42. This angular offset allows the antenna to simultaneously achieve both LHCP and RHCP. Particularly, the first and second planes 42, 48 are not co-planar with one another and an angle may be measured between the first and second planes 42, 48. The angle between the first and second planes 42, 48 directly affects the polarization of the antenna 20 at each of the frequency bands. The angle between the first and second planes 42, 48 is preferably between 0 and 90 degrees and more preferably between 15 and 75 degrees. In the illustrated embodiments, where circular polarization is achieved from both patch elements 28, 32, the angle between the first and second planes 42, 48 is about 45 degrees, as is shown in FIGS. 4, 5, 9, and 10. To achieve linear polarization, the angle between the first and second planes 42, 48 is about 0 degrees. That is, the first and second planes 42, 48 are actually the same plane. To achieve elliptical polarization, the angle between the first and second planes 42, 48 is preferably between that to achieve circular or linear polarization.

Figure 4:
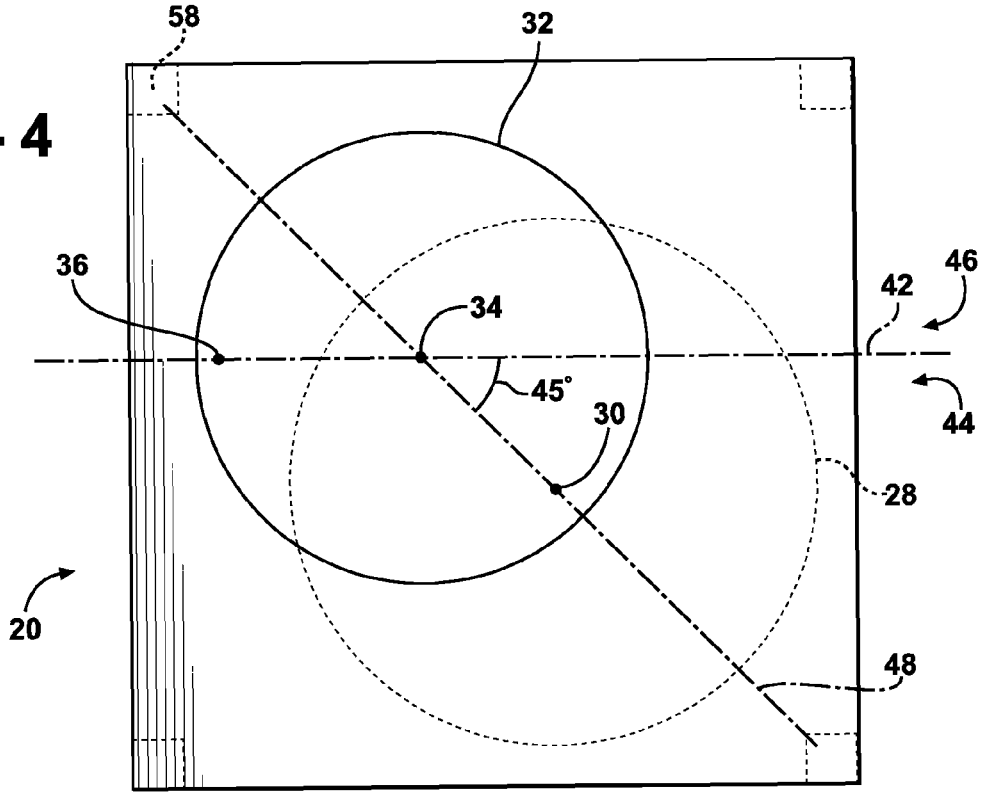
FIG. 4 is an interior view of the first embodiment of the antenna taken along the line 4-4 in FIG. 3 showing the angular relationship between the first and second patch elements.
Figure 5:
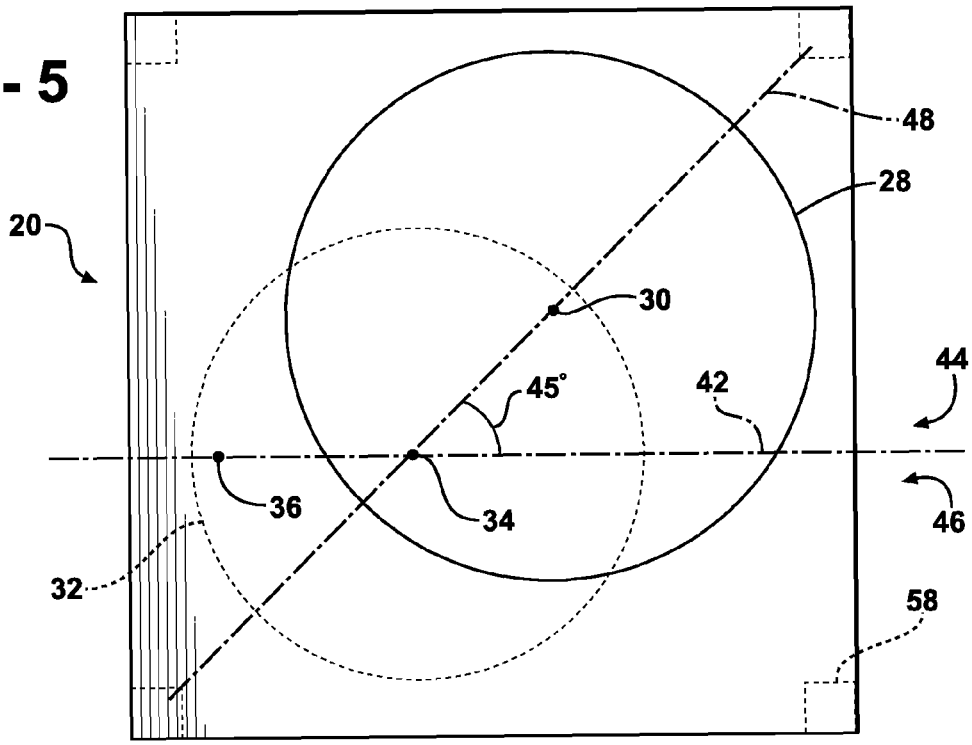
FIG. 5 is a top view of the first embodiment of the antenna taken along the line 5-5 in FIG. 3 showing the angular relationship between the first and second patch elements.
Figure 6:
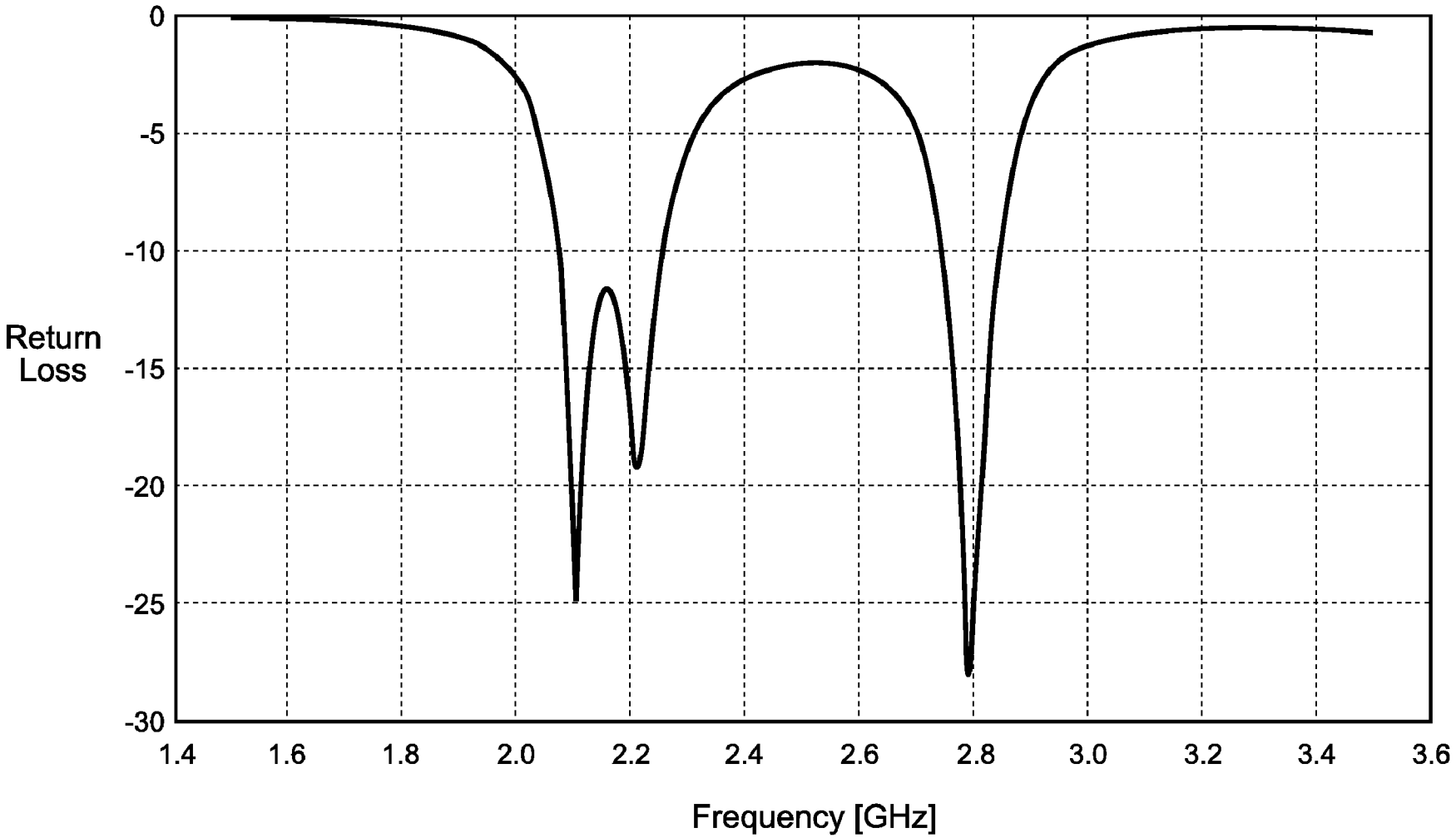
FIG. 6 is a chart showing return loss of the first embodiment of the antenna at various frequencies.
Figure 7:
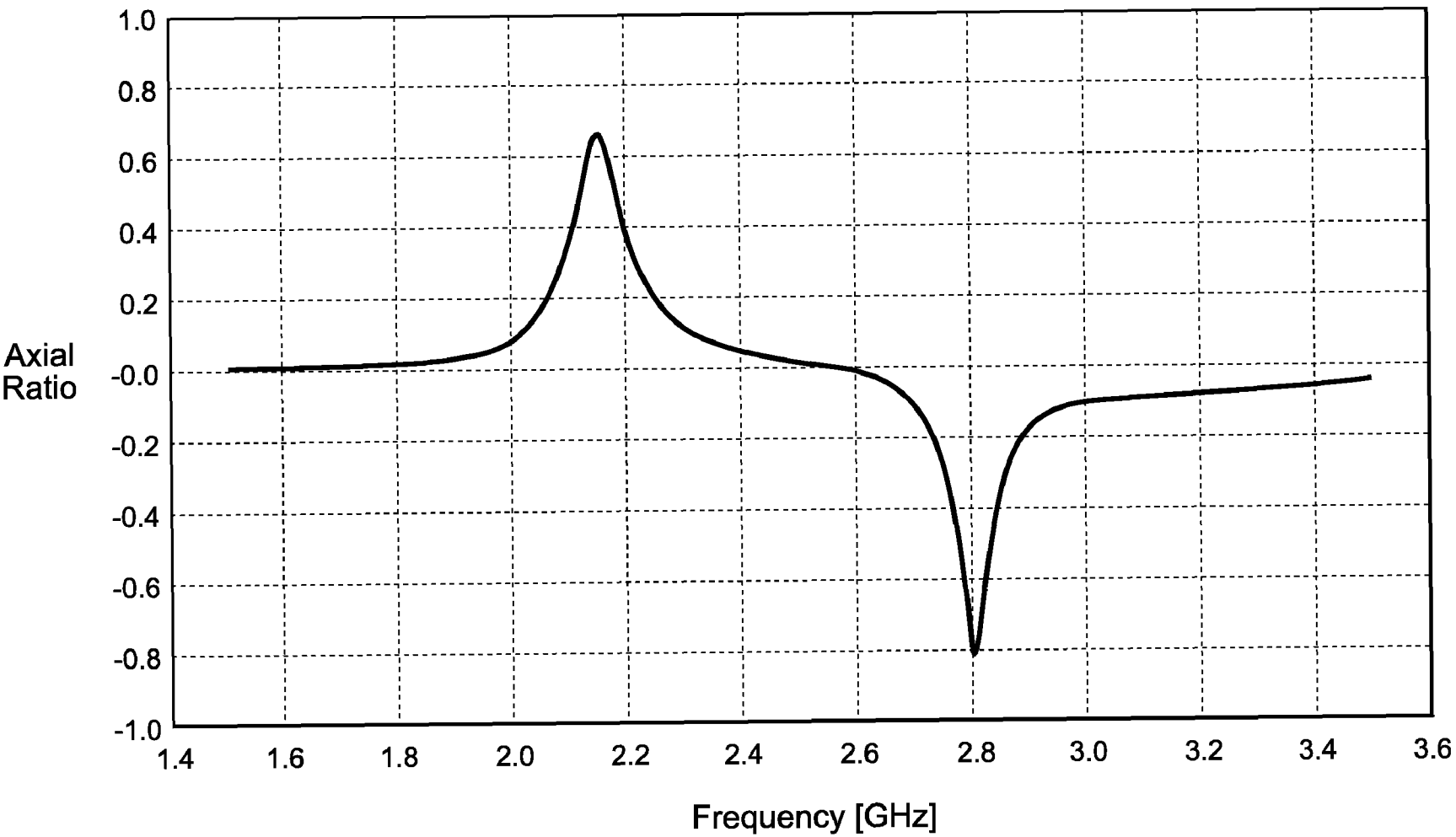
FIG. 7 is a chart showing axial ratio of the first embodiment of the antenna at various frequencies.
Figure 8:
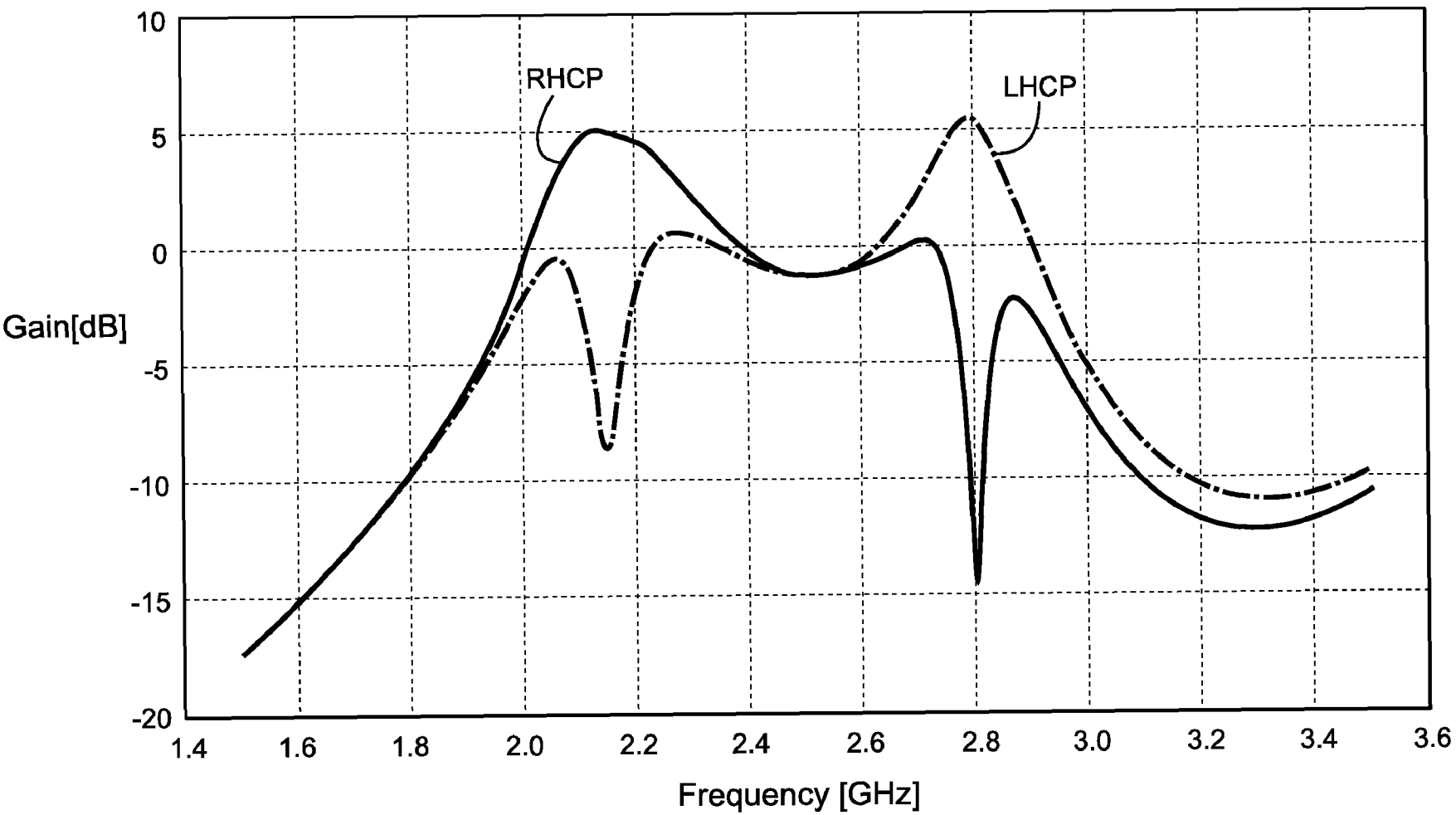
FIG. 8 is a chart showing both the right hand circular polarization (RHCP) gain and the left hand circular polarization (LHCP) gain of the first embodiment of the antenna at various frequencies.
Figure 10:
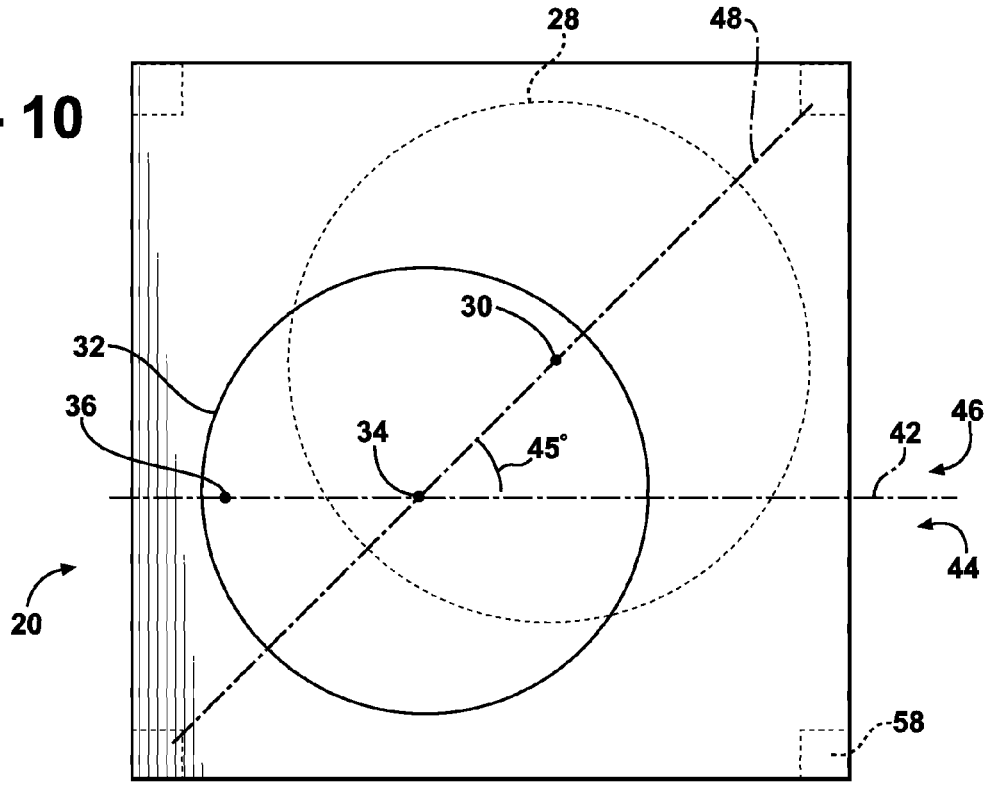
FIG. 10 is an interior view of a third embodiment of the antenna showing the angular relationship between the first and second patch elements.
Figure 11:
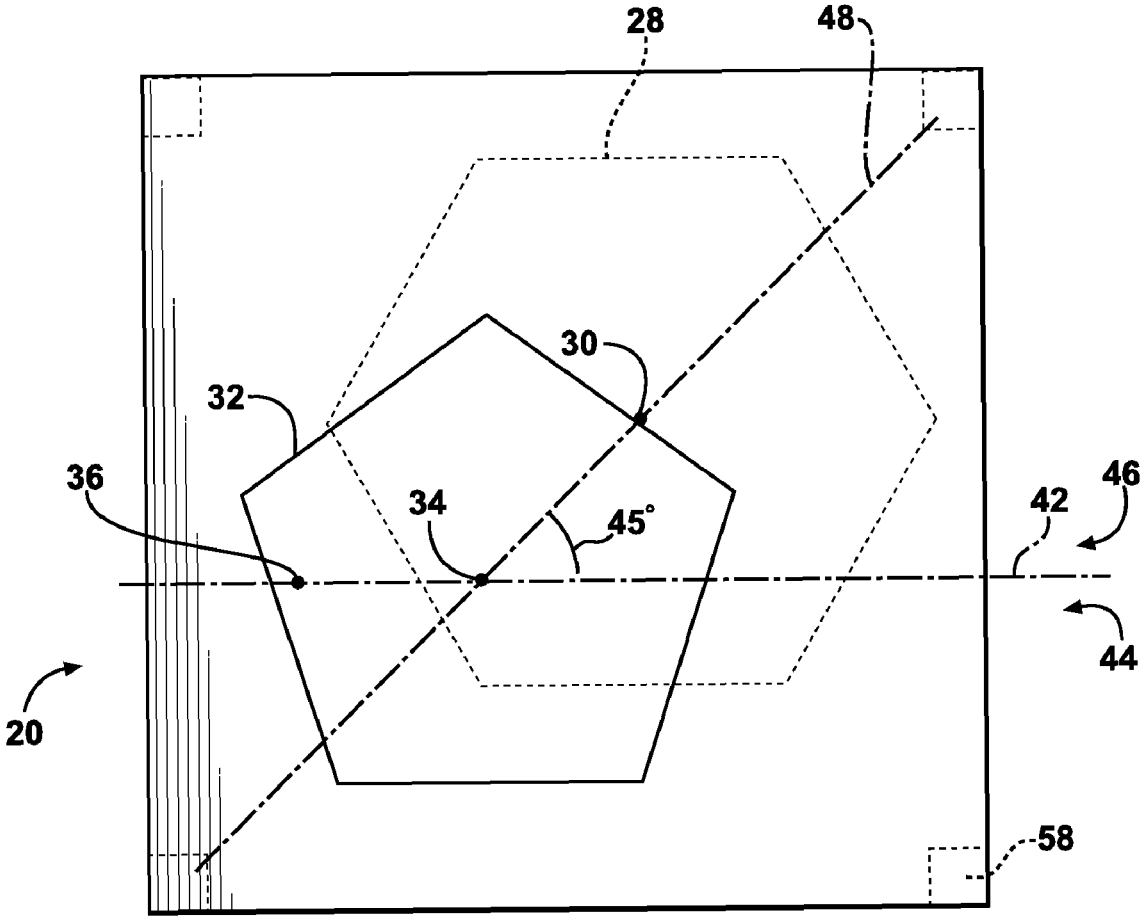
FIG. 11 is an interior view of a fourth embodiment of the antenna showing the first patch element with a hexagon shape and the second patch element with a pentagon shape.

The particular sense of the circular polarization, i.e., right-hand or left-hand, of each patch element 28, 32 is also dictated by the angular offset relationship between the patch elements 28, 32. In the first embodiment, as shown in FIGS. 4 and 5, the angle between the first and second planes 42, 48 is about 45 degrees and the center 30 of the first patch element 28 is disposed in the first region 44. This results in RHCP for the first frequency band and LHCP for the second frequency band. In a third embodiment, as shown in FIG. 10, the angle between the first and second planes 42, 48 is also about 45 degrees; however, the center 30 of the first patch element 28 is disposed in the second region 46. This results in LHCP for the first frequency band and RHCP for the second frequency band. Therefore, the circular polarization of the patch elements 28, 32 may be "swapped" by changing the sense of the patch elements 28, 32 with respect to one another.

Referring again to FIG. 3, the antenna 20 preferably includes a ground plane 50 spaced from and non-planar with the second patch element 32. More preferably, the ground plane 50 is spaced below the second patch element 32, and accordingly, below the first patch element 28. The ground plane 50 is formed of a conductive material and serves to reflect electromagnetic radiation as is well known to those skilled in the art.

At least one dielectric layer is sandwiched between the first and second patch elements 28, 32. More preferably, as shown in the illustrated embodiments, a first dielectric layer 52 and a second dielectric layer 54 are disposed between the patch elements 28, 32. Specifically, the first dielectric layer 52 is disposed adjacent the first patch element 28 and the second dielectric layer 54 is adjacent the second patch element 32. At least one dielectric layer is also sandwiched between the second patch element 32 and the ground plane 50. Specifically, in the illustrated embodiments, a third dielectric layer 56 is disposed between the second patch element 32 and the ground plane 50. Each dielectric layer 52, 54, 56 is formed of a non-conductive material.

The first dielectric layer 52 has a first permittivity and the second dielectric layer 54 has a second permittivity. To aid in achieving circular polarization of the antenna 20, it is preferred that the second permittivity is less than the first permittivity. Specifically, in the illustrated embodiments, the first permittivity of the first dielectric layer 52 is about 4 and the second permittivity of the second dielectric layer 54 is about 1. Since the second permittivity is about 1, the second dielectric layer 54 is formed of air. As such, spacers 58 are utilized to separate the first dielectric layer 52 from the second patch element 32 and the third dielectric layer 56. Of course, those skilled in the art realize that the second dielectric layer 54 may be implemented with an alternative substance other than air to achieve the preferred permittivity of about 1. In the illustrated embodiment, the first and third dielectric layers 52, 56 each have a thickness of about 1.6 mm. The second dielectric layer 54, and accordingly, the spacers 58, has a thickness of about 1.0 mm.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A patch antenna comprising:

a first patch element having a center;

a second patch element having a center and spaced from and non-planar with said first patch element;

a connection point defined on said second patch element for a connection to a transmission line;

a first plane defined through said connection point and said center of said second patch element and generally perpendicular to said second patch element; and said first patch element disposed offset said second patch element such that said center of said first patch element does not intersect with said first plane.

2. A patch antenna as set forth in claim 1 further comprising a second plane defined through said center of said first patch element and said center of said second patch element, generally perpendicular to said patch elements, and offset from said first plane.

3. A patch antenna as set forth in claim 2 wherein an angle between said first and second planes is greater than 0 degrees and less than 90 degrees.

4. A patch antenna as set forth in claim 2 wherein an angle between said first and second planes is greater than 15 degrees and less than 75 degrees.

5. A patch antenna as set forth in claim 2 wherein an angle between said first and second planes is about 45 degrees.

6. A patch antenna as set forth in claim 1 wherein said first patch element defines a periphery having a first length and said second patch element defines a periphery having a second length different from said first length.

7. A patch antenna as set forth in claim 6 wherein said second length is less than said first length.

8. A patch antenna as set forth in claim 1 wherein at least one of said first and second patch elements define a circular shape.

9. A patch antenna as set forth in claim 1 wherein at least one of said first and second patch elements define a polygonal shape that is symmetrical about an axis through said center of said patch element.

10. A patch antenna as set forth in claim 1 further comprising a ground plane spaced from and non-planar with said second patch element.

11. A patch antenna as set forth in claim 10 further comprising at least one dielectric layer sandwiched between said second patch element and said ground plane.

12. A patch antenna as set forth in claim 1 further comprising at least one dielectric layer sandwiched between said first and second patch elements.

13. A patch antenna as set forth in claim 12 wherein said at least one dielectric layer is further defined as a first dielectric layer disposed adjacent said first patch element and a second dielectric layer disposed adjacent said second patch element.

14. A patch antenna as set forth in claim 13 wherein said first dielectric layer has a first permittivity and said second dielectric layer has a second permittivity less than said first permittivity.

15. A patch antenna as set forth in claim 1 further comprising a conductor of a transmission line electrically connected to said second patch element at said connection point for electrically connecting said antenna to a transmitter and/or a receiver.

16. A patch antenna as set forth in claim 1 wherein said first plane separates a first region from a second region.

17. A patch antenna as set forth in claim 16 wherein said center of said first patch element is disposed in said first region.

18. A patch antenna as set forth in claim 16 wherein said center of said first patch element is disposed in said second region.

19. A window for a vehicle comprising said antenna of claim 1 disposed on a pane of glass.

20. A patch antenna comprising:

a first patch element having a center;

a second patch element having a center and spaced from and non-planar with said first patch element;

said first patch element defines a periphery having a first length and said second patch element defines a periphery having a second length different from said first length;

a connection point defined on said second patch element for a connection to a transmission line;

a first plane defined through said connection point and said center of said second patch element and generally perpendicular to said second patch element;

a second plane defined through said center of said first patch element and said center of said second patch element and generally perpendicular to said patch elements; and wherein an angle between said first and second planes is about 45 degrees.

* * * * *